US008596237B2

(12) United States Patent
Popp et al.

(10) Patent No.: US 8,596,237 B2
(45) Date of Patent: Dec. 3, 2013

(54) ACTUATOR UNIT HAVING TWO ACTUATOR PINS

(75) Inventors: Oliver Popp, Hirschaid/Juliushof (DE); Ronny Gunnel, Puschendorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/529,201

(22) Filed: Jun. 21, 2012

(65) Prior Publication Data

US 2013/0000581 A1 Jan. 3, 2013

(30) Foreign Application Priority Data

Jun. 28, 2011 (DE) ..... 10 2011 078 154

(51) Int. Cl.
*F01L 1/34* (2006.01)

(52) U.S. Cl.
USPC ..... 123/90.18; 123/90.6; 29/888.1

(58) Field of Classification Search
USPC ..... 123/90.18, 90.6; 29/888.1
See application file for complete search history.

(56) References Cited

U.S. PATENT DOCUMENTS 8,191,524 B2 * 6/2012 Elendt et al. ..... 123/90.6

FOREIGN PATENT DOCUMENTS

WO 2010097298 9/2010

* cited by examiner

*Primary Examiner* — Ching Chang
(74) *Attorney, Agent, or Firm* — Volpe and Koenig, P.C.

(57) ABSTRACT

An internal combustion piston engine having gas exchange valves actuated by cams of a camshaft. The cams are sliding cams having two cams per sliding cam unit situated on a basic shaft in rotationally fixed fashion but axially displaceable. At least one actuator unit has two actuator pins for displacing the sliding cam units into different axial positions using displacement grooves on the circumference of the sliding cam units, the grooves being helical and situated mirror-symmetrically, and having an ejection ramp for the actuator pins. The actuator pins are spring-loaded toward the sliding cam unit and, in retracted positions, can be fixed by arresting devices, which have control needles that correspond to clamping bodies of locking devices. These needles are actuatable by an electromagnet unit, with the control needles being connected with a needle bridge. A pin engages the needle bridge, and the pin is controlled by the electromagnet unit.

7 Claims, 1 Drawing Sheet

1
2
3
4
5
6
7
8
9
10
11
12
13
14
15
16
17
18
A

ACTUATOR UNIT HAVING TWO ACTUATOR PINS

CROSS-REFERENCE TO RELATED APPLICATIONS

This application claims the benefit of German Patent Application No. 102011078154.4, filed Jun. 28, 2011, which is incorporated herein by reference as if fully set forth.

FIELD OF THE INVENTION

An internal combustion piston engine having a crank drive, having at least one cylinder head whose inlet and outlet channels are each governed by at least one gas exchange valve, formed as intake and exhaust valves, which valves are capable of being actuated by cams of at least one camshaft and by transmitting elements driven by the cams, with the cams being fashioned as sliding cams having at least two cams per sliding cam unit which are situated on a basic shaft in rotationally fixed fashion but so as to be capable of being displaced axially on the shaft, the basic shaft being mounted so as to be fixed relative to the internal combustion engine, and having at least one actuator unit, fixed relative to the internal combustion engine, having two actuator pins on the circumference of the sliding cam units for displacing the sliding cam units into different axial positions using at least two displacement grooves that work together with the actuator pins, with the grooves being made helical and situated mirror-symmetrically to one another, and having at least one ejection ramp for the actuator pins, the actuator pins being spring-loaded in the direction toward the sliding cam unit and, in their retracted positions facing away from the sliding cam unit, being capable of being fixed by arrestable locking devices, the arresting devices having control needles that correspond to clamping bodies of the locking devices, with the needles being capable of being actuated by an electromagnet unit.

BACKGROUND OF THE INVENTION

Such an actuator unit for internal combustion piston engines, having two actuator pins, is known from WO 2010/097 298 A1. The offsetting of the two control needles relative to the mid-axis of the electromagnet unit results in a suboptimal utilization of the magnetic field flux, so that in order to achieve a required magnetic force a larger coil tends to be required, resulting in a larger constructive space.

SUMMARY

The object of the present invention is therefore to improve an actuator unit for internal combustion piston engines in such a way that the above-described disadvantages are avoided. This is to be achieved using simple and economical means.

This objective is achieved in that the control needles stand in operative connection with a needle bridge, and that a pin engages on the needle bridge, with the pin being controlled by the electromagnet unit.

The pin, preferably fashioned as a permanent magnet needle, is held so as to be axially displaceable in a bearing cover, and is connected to a plate and to a permanent magnet that together form a coil armature. This central situation of an armature makes it possible to use a larger centrally situated permanent magnet and a larger plate, and thus to produce a sufficiently large retraction signal. The retraction signal is a signal that indicates the retracted position of at least one of the actuator pins. Resulting from this, the coil of the electromagnet unit can be made more compact and with lower magnetic power.

The control needles engage at the ends of the needle bridge and are loaded by springs that are supported on the bearing cover. The needle bridge surrounds, with a radial space, the permanent magnet needles and control needles, and forms with them, on the one side, flat supports, and on the other side forms a respective hemispheric bearing. The flat support surfaces between the needle bridge and the permanent magnet needle and control needles has the effect that when current is supplied to the coil the needle bridge synchronously attracts both control needles, while simultaneously triggering both actuator pins. When the actuator pins are pushed back into their inner position, a different height position of the two control needles relative to one another can be compensated by the hemispheric bearing between the needle bridge, the permanent magnet needle, and the control needles. This is desirable because one control needle can if necessary remain in the inner locked position, and the other control needle can be situated at the lower, unlocked position. As soon as the previously still-unlocked control needle is pushed back so that it is also in the locked position, the clamping force on the previously locked side can even be increased. In addition, starting from a particular force level the coil armature is pushed in the direction of the magnet coil, generating a retraction signal. A compensation of manufacturing tolerances between two clamped positions of the actuator pins can also take place via the needle bridge.

The bearing cover is supported in a guide sleeve that accommodates the actuator pins, said sleeve forming a component of the actuator unit.

BRIEF DESCRIPTION OF THE DRAWINGS

For the further explanation of the present invention, reference is made to the drawings, in which a simplified representation of an exemplary embodiment of the present invention is shown.

DETAILED DESCRIPTION OF THE PREFERRED EMBODIMENTS

Figures 1, 2:
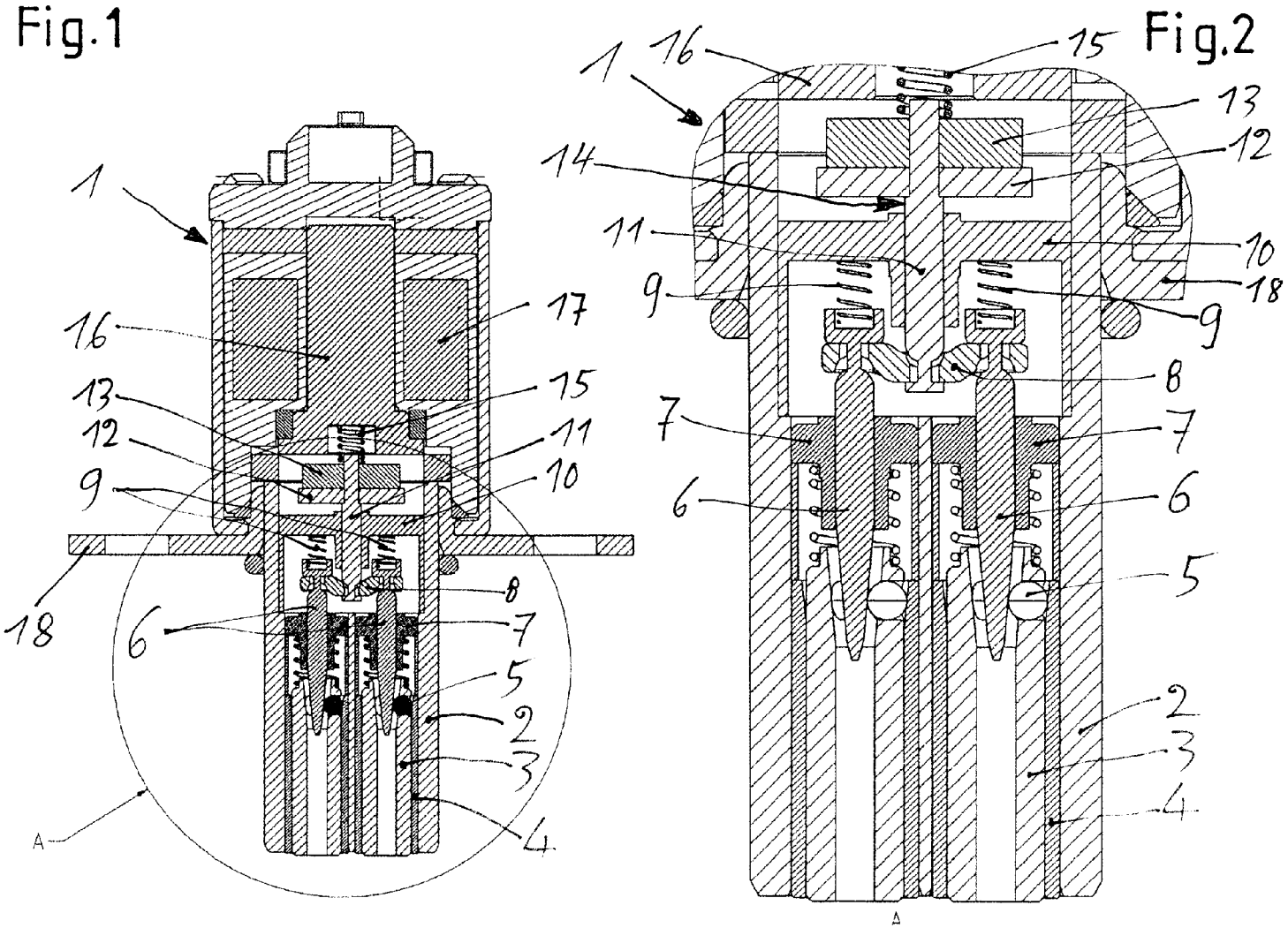
FIG. 1 shows a section through an actuator unit and two actuator pins.
FIG. 2 shows a section through the actuator unit in an enlarged scale according to the circle A in FIG. 1.

In FIGS. 1 and 2, insofar as the parts are shown individually, 1 generally designates an actuator unit having a guide sleeve 2 in which actuator pins 3 are mounted so as to be axially movable. In the guide sleeve 2, bearing sleeves 4 are placed that are widened at their upper, inner end. At the level of the widening, the actuator pins 3 have clamping bodies 5, fashioned as balls, that are displaceably held in radial openings of the actuator pins 3. The clamping bodies 5 stand in operative connection with control needles 6, which have a conical construction and which, by displacement, cause a radial movement of the clamping bodies 5 outward, or release these bodies. In this way, in the upper end position of the actuator pins 3 there takes place an arrestable locking of the actuator pins. The actuator pins 3 are loaded by pressure springs that are supported in bearings 7 that simultaneously take over the guiding of the control needles 6. If the arresting of the clamping bodies 5 by the control needles 6 is released, the actuator pins are moved outward by the pressure springs, in the direction of a sliding cam unit (not shown), so that the actuator pins 3 can penetrate into sliding grooves, thus bringing about a displacement of the sliding cam units. The control needles 6 are connected to a needle bridge 8 and are further loaded by springs 9 that are supported on a bearing cover 10 that is fixed in the guide sleeve 2. A permanent magnet needle 11 engages centrally in the bearing bridge 8, said magnet needle being guided in the bearing cover 10 so as to be axially displaceable and being connected to a plate 12 and to a permanent magnet 13. The permanent magnet needle 11, the plate 12, and the permanent magnet 13 form a coil armature 14 that is loaded by a pressure spring 15 in the direction of the actuator pins 3, so that the pressure spring 15 is supported on a magnet core 16 that is surrounded by a magnet coil 17 that is housed in a head of the actuator unit 1. The guide sleeve 2 is connected to a fastening flange 18 on which the head of the actuator unit 1 is also supported.

The permanent magnet needle 11 and the control needles 6 have constrictions that stand in operative connection with openings in the needle bridge 8, the openings being larger than the constrictions, so that some play results. The needle bridge 8 further forms, with the control needles 6 and with the permanent magnet needle 11, on the one side flat support surfaces and on the other side hemispheric bearings. The flat support surfaces are situated such that when current is supplied to the magnet coil 17 and force acts on the coil armature 14, the flat surfaces between the needle bridge 8, the control needles 6, and the permanent magnet needle 11 come to bear, so that both of the control needles 6 are synchronously attracted, thus releasing the arresting of both actuator pins 3. When the actuator pins 3 are pushed back in, e.g. by the eject ramp of a displacement groove, via the hemispheric bearing and its pivot possibility in connection with the play in the openings there results a balance beam effect that permits different positions of the control needles 6 and of the needle bridge 8.

LIST OF REFERENCE CHARACTERS

1 actuator unit
2 guide sleeve
3 actuator pins
4 bearing sleeve
5 clamping body
6 control needles
7 bearing
8 needle bridge
9 springs
10 bearing cover
11 permanent magnet needle
12 plate
13 permanent magnet
14 coil armature
15 pressure spring
16 magnet core
17 magnet coil
18 fastening flange

The invention claimed is:

1. An internal combustion piston engine comprising a crank drive, at least one cylinder head whose inlet and outlet channels are each governed by at least one gas exchange valve, formed as intake and exhaust valves, said valves being actuated by cams of at least one camshaft and by transmitting elements driven by said cams, the cams being fashioned as sliding cam units having at least two cams per sliding cam unit which are situated on a basic shaft in rotationally fixed fashion but so as to be capable of being displaced axially on said basic shaft, said basic shaft being mounted so as to be fixed axially relative to the internal combustion engine, and having at least one actuator unit, fixed relative to the internal combustion engine, having two actuator pins for displacing the sliding cam units into different axial positions using at least two displacement grooves on a circumference of the sliding cam unit that work together with the actuator pins, said grooves being made helical and situated mirror-symmetrically to one another, and having at least one ejection ramp for the actuator pins, the actuator pins being spring-loaded in a direction toward the sliding cam unit and, in a retracted position facing away from the sliding cam unit, being fixed by arresting devices, the arresting devices having control needles that correspond to clamping bodies of the locking devices, said control needles being actuated by an electromagnet unit, the control needles stand in operative connection with a needle bridge, and a pin engages on the needle bridge, said pin being controlled by the electromagnet unit.

2. The internal combustion piston engine as recited in claim 1, wherein the pin is fashioned as a permanent magnet needle that is held in a bearing cover so as to be axially displaceable, and is connected to a plate and to a permanent magnet that form a coil armature.

3. The internal combustion piston engine as recited in claim 1, wherein the control needles (6) engage on ends of the needle bridge and are loaded by springs that are supported on the bearing cover.

4. The internal combustion piston engine as recited in claim 1, wherein the needle bridge surrounds, with a radial space, the permanent magnet needle and the control needles.

5. The internal combustion piston engine as recited in claim 4, wherein the needle bridge forms hemispheric bearings with the permanent magnet needle and the control needles.

6. The internal combustion piston engine as recited in claim 1, wherein the coil armature is loaded by a pressure spring (15) that is supported on a magnet core.

7. The internal combustion piston engine as recited in claim 1, wherein the bearing cover is supported in a guide sleeve that accommodates the actuator pins, said guide sleeve forming a component of the actuator unit.

* * * * *